US010731493B2

(12) United States Patent
Davis et al.

(10) Patent No.: US 10,731,493 B2
(45) Date of Patent: Aug. 4, 2020

(54) GAS TURBINE ENGINE SEAL

(71) Applicant: United Technologies Corporation, Hartford, CT (US)

(72) Inventors: Timothy M. Davis, Kennebunk, ME (US); Mark J. Rogers, Kennebunk, ME (US); Mark Broomer, Portsmouth, NH (US); Craig R. McGarrah, Southington, CT (US); Carson A. Roy Thill, South Berwick, ME (US)

(73) Assignee: Ratheyon Technologies Corporation, Farmington, CT (US)

( * ) Notice: Subject to any disclaimer, the term of this patent is extended or adjusted under 35 U.S.C. 154(b) by 794 days.

(21) Appl. No.: 14/783,048

(22) PCT Filed: Apr. 10, 2014

(86) PCT No.: PCT/US2014/033649

§ 371 (c)(1),
(2) Date: Oct. 7, 2015

(87) PCT Pub. No.: WO2014/169120

PCT Pub. Date: Oct. 16, 2014

(65) Prior Publication Data

US 2016/0061047 A1 Mar. 3, 2016

Related U.S. Application Data

(60) Provisional application No. 61/811,488, filed on Apr. 12, 2013.

(51) Int. Cl.
*F01D 11/00* (2006.01)
*F01D 9/04* (2006.01)
(Continued)

(52) U.S. Cl.
CPC ..... *F01D 11/005* (2013.01); *F01D 9/04* (2013.01); *F01D 11/003* (2013.01); *F01D 11/08* (2013.01);
(Continued)

(58) Field of Classification Search
CPC ..... F01D 11/005; F01D 11/08; F01D 11/003; F01D 25/24; F01D 9/04; F05D 2240/55;
(Continued)

(56) References Cited

U.S. PATENT DOCUMENTS 4,441,726 A * 4/1984 Uhl ..... F16J 15/0812 277/637
9,127,557 B2 * 9/2015 Davis, III ..... F01D 9/041
(Continued)

OTHER PUBLICATIONS

EP search report for EP14783452.7 dated Jul. 29, 2016.

*Primary Examiner* — David E Sosnowski
*Assistant Examiner* — Danielle M. Christensen
(74) *Attorney, Agent, or Firm* — Getz Balich LLC

(57) ABSTRACT

A seal for sealing a radially outer component of a gas turbine engine stator to a radially inner component thereof includes an axially resilient seal carrier adapted for mounting the seal carrier and including at a radially inner portion thereof, a pair of radially spaced, axially extending, radially resilient jaws adapted to clamp a sealing element such as a rope seal there between in sealing engagement with a radially inner component of the engine stator.

18 Claims, 2 Drawing Sheets

(51) Int. Cl.
*F01D 11/08* (2006.01)
*F01D 25/24* (2006.01)

(52) U.S. Cl.
CPC ..... *F01D 25/24* (2013.01); *F05D 2220/32* (2013.01); *F05D 2240/12* (2013.01); *F05D 2240/55* (2013.01); *F05D 2260/38* (2013.01); *F05D 2300/175* (2013.01); *F05D 2300/177* (2013.01); *F05D 2300/20* (2013.01); *F05D 2300/614* (2013.01)

(58) Field of Classification Search
CPC .. F05D 2260/38; F16J 15/067; F16J 15/0831; F16J 15/0887; F16J 15/06; F16J 15/062; F16J 15/00; F16J 15/02; F16J 15/021; F16J 15/022; F16J 15/024; F16J 15/025; F16J 15/027; F02C 7/28
See application file for complete search history.

(56) References Cited

U.S. PATENT DOCUMENTS

| | | | | |
|---|---|---|---|---|
| 2005/0040602 | A1 | 2/2005 | Beichl et al. | |
| 2006/0038358 | A1 | 2/2006 | James | |
| 2006/0137724 | A1* | 6/2006 | Powers ..... | C11D 3/042 134/41 |
| 2007/0160471 | A1 | 7/2007 | Welch | |
| 2008/0063514 | A1 | 3/2008 | Durocher et al. | |
| 2010/0080699 | A1 | 4/2010 | Pietrobon et al. | |
| 2012/0177486 | A1 | 7/2012 | Ullah et al. | |
| 2013/0084166 | A1 | 4/2013 | Klingels | |
| 2014/0265161 | A1* | 9/2014 | Sutterfield ..... | F02K 1/805 277/642 |

* cited by examiner

GAS TURBINE ENGINE SEAL

This application claims priority to PCT Patent Appln. No. PCT/US14/033649 filed Apr. 10, 2014, which claims priority to U.S. Patent Appln. No. 61/811,488 filed Apr. 12, 2013.

BACKGROUND OF THE INVENTION

1. Technical Field

This invention relates generally to gas turbine engines and particularly to a gas turbine engine seal.

2. Background Information

In the construction of gas turbine engines, it is often necessary to provide seals between adjacent hardware components to prevent or control leakage of fluids between such components. For example, it is crucial that effective sealing be provided in the flow path for gas turbine engine compressor discharge cooling air. The turbine section of a gas turbine engine operates at temperatures well above 1,000° C. To minimize thermal degradation of turbine components, it is necessary to internally cool such components with the engine's compressor discharge air. Such compressor discharge cooling air is unavailable to support the combustion of fuel in the engine's combustor. Therefore, it is crucial that the flow of such compressor discharge cooling air be precisely controlled at least in part by appropriate sealing techniques. Use of excess compressor discharge cooling air beyond what is required for adequate cooling of the engine's components can lower the overall efficiency of the engine.

The prior art discloses several arrangements for sealing gas turbine engine components. A well-known arrangement for sealing gas turbine engine components involves the disposition of flexible seals such as rope seals or the like within a component groove or slot. Such prior art sealing arrangements have met with only limited success due to the harsh environment within which such gas turbine engine components must operate. For example, the extreme temperatures encountered by turbine components cause thermal expansion and contraction of such components. Extreme working fluid pressures encountered by engine components can cause unintended movement thereof. Such movement and thermal expansion and contraction of the components can result in loosening of the sealing elements within the slots and even migration of the seal elements from the slots. Moreover, the harsh environment encountered by such seals can result in deformation of the seals thereby compromising the effectiveness of the seals. Accordingly, it remains a challenge to effectively seal gas turbine engine components within harsh environments encountered by such engine components.

SUMMARY OF THE DISCLOSURE

In accordance with the present invention, two radially offset components of a gas turbine engine stator assembly are sealed to each other by a seal including an axially resilient seal carrier fixed to one of the components at a radially outer portion of the seal carrier and extending from that stator component toward the other stator component and terminating at a radially inner portion of the seal carrier at a location proximal to the second component. The radially inner portion of the seal carrier includes a pair of radially spaced, radially resilient jaws adapted to receive a sealing element there between in a clamped compressive engagement with the jaws, the sealing element being adapted to engage the second stator component in sealing contact therewith. The seal carrier is axially resilient to accommodate differential thermal axial expansion and contraction and differential axial movement of the first and second stator components normally encountered in the operation of the gas turbine engine. In an additional or alternative embodiment of the foregoing embodiment, the seal carrier and jaws are generally annular and the seal element comprises a rope seal.

In an additional embodiment of the foregoing embodiment, the first and second components comprise an engine case and a turbine outer air seal respectively. In an additional embodiment of the foregoing embodiments, the engine case is disposed radially outwardly of the turbine outer air seal and the seal carrier is fixed to the engine case at the radially outer portion of the seal carrier. In another additional embodiment of the foregoing embodiments, a radially outer end of the seal carrier is apertured to accommodate a fastener there through which fixes the seal carrier to the engine case. In another additional embodiment of the foregoing embodiments, the engine case includes a seal mounting flange, the seal carrier being fixed to the engine case at the seal mounting flange and the fastener comprises a threaded fastener. In still another embodiment of the foregoing embodiments, the seal carrier comprises a pair of mutually overlying flexible leaves, each of the leaves extending radially inwardly from the first component and terminating at a radially inner portion which includes one of the jaws formed integrally therewith. In another embodiment of the foregoing embodiments, each jaw is provided with a recess in an inner surface thereof for the enhanced retention of the sealing element. In still another embodiment of the foregoing embodiments, the seal carrier jaws are annular and circumferentially segmented to render the jaws radially resilient. In still another embodiment of the foregoing embodiments, the rope sealing element is formed at least in part from refractory ceramics. In yet another embodiment of the foregoing embodiments, the rope sealing element is formed from metallic wires. In still another embodiment of the foregoing embodiments, the seal carrier is formed from a nickel based alloy.

DETAILED DESCRIPTION OF THE INVENTION

Figure 1:
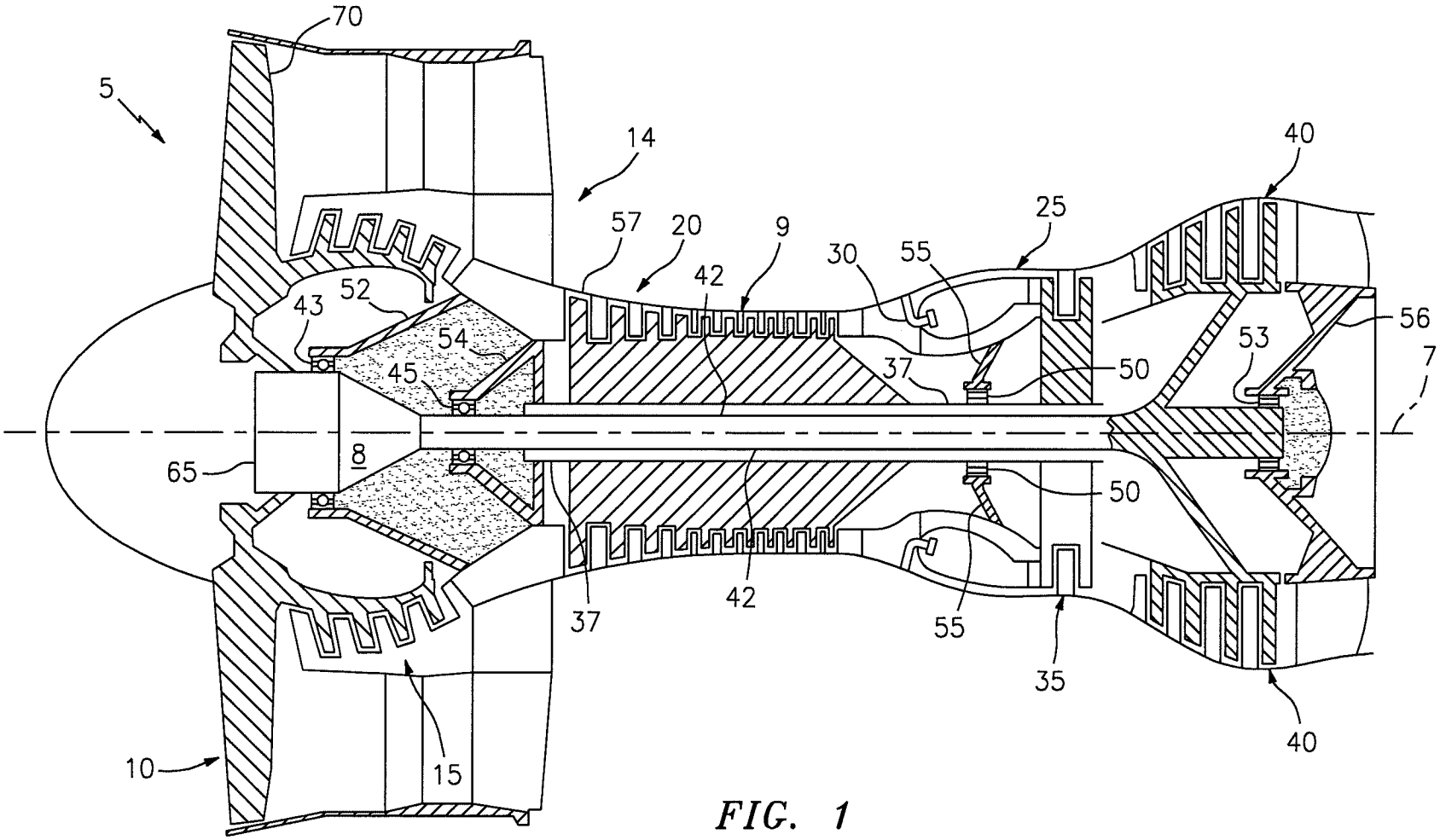
FIG. 1 is a simplified partially sectioned schematic elevation of a turbofan gas turbine engine of the type employing the gas turbine engine seal.

Referring to FIG. 1, a turbofan gas turbine engine 5 has a longitudinal axis 7 (e.g., a central axis) about which bladed rotors 8 within vaned stator 9 rotate, stator 9 circumscribing the rotors. A fan 10 disposed at the engine inlet draws air into the engine. A low pressure compressor 15 located immediately downstream of fan 10 compresses air exhausted from fan 10 and a high pressure compressor 20 located immediately downstream of low pressure compressor 15, further compresses air received therefrom and exhausts such air to combustors 25 disposed immediately downstream of high pressure compressor 20. Combustors 25 receive fuel through fuel injectors 30 and ignite the fuel/air mixture. The burning fuel-air mixture (working medium fluid) flows axially to a high pressure turbine 35 which extracts energy from the working medium fluid and in so doing, rotates hollow shaft 37, thereby driving the rotor of high pressure compressor 20. The working medium fluid exiting the high pressure turbine 35 then enters low pressure turbine 40, which extracts further energy from the working medium fluid. The low pressure turbine 40 provides power to drive the fan 10 and low pressure compressor 15 through low pressure rotor shaft 42, which is disposed interiorly of the hollow shaft 37, coaxial thereto. Working medium fluid exiting the low pressure turbine 40 provides axial thrust for powering an associated aircraft (not shown) or a free turbine (also not shown) which may be drivingly connected to a rotor of industrial equipment such as a pump or electrical generator.

Bearings 43, 45, 50 and 53 radially support the concentric high pressure and low pressure turbine shafts from separate frame structures 52, 54, 55 and 56 respectively, attached to engine case 57, which defines the outer boundary of the engine's stator 9. However, the present invention is also well suited for mid-turbine frame engine architectures wherein the upstream bearings for the low and high pressure turbines are mounted on a common frame structure disposed longitudinally (axially) between the high and low pressure turbines.

Figure 2:
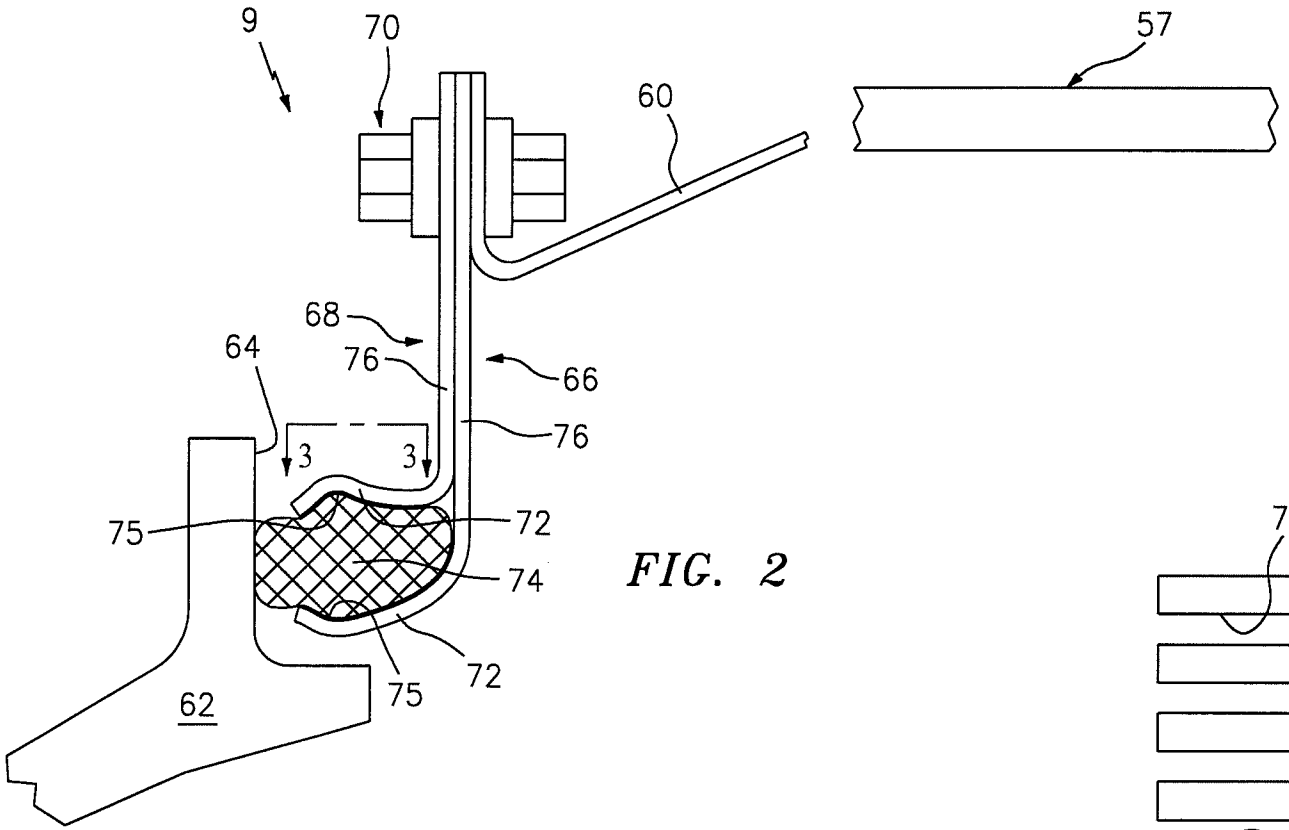
FIG. 2 is a side elevation of a portion of the stator of the gas turbine engine illustrated in FIG. 1 and showing a gas turbine engine seal.
Figure 3:
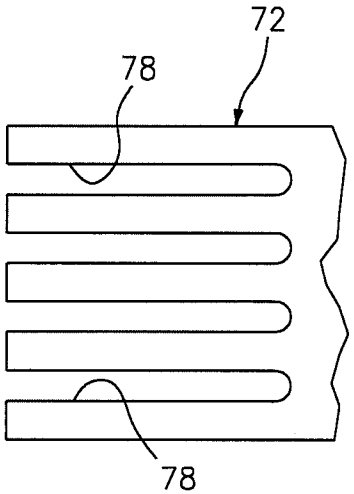
FIG. 3 is a plan view of a portion of the gas turbine engine seal taken in the direction of line 3-3 in FIG. 2.

Referring to FIG. 2, a portion of engine stator 9 is shown. A seal mounting flange 60 extends radially inwardly and forwardly of a portion of case 57. A portion of radially inwardly disposed turbine outer air seal is shown at 62 and includes a sealing surface 64 thereon. The gas turbine engine seal of the present invention is shown generally at 66 and includes a seal carrier 68 fixed at a first radially outer end thereof to seal mounting flange 60 of case 57. To this end, seal carrier 66 is apertured at the first end thereof to receive a threaded fastener arrangement 70 such as a shear lock fastener. Seal carrier 68 extends radially inwardly from seal mounting flange 60 and terminates at a second end proximal to sealing surface 64 of turbine outer air seal 62. The second end of the seal carrier includes a pair of radially spaced radially resilient jaws 72 which receive there between rope sealing element 74 which is maintained in clamped, compressive engagement with the jaws 72 rope sealing element 74 being in sealing contact with turbine outer air seal 62. Each of the jaws includes a recess 75 formed in the inner surface thereof for enhanced retention of the rope sealing element. Since the engine case and seal mounting flange 60 thereof are generally annular, as is turbine outer air seal 62, seal carrier 66 and rope seal element 74 are also generally annular. In an embodiment, seal carrier 68 includes a pair of overlying radially extending leaves 76 which extend from the radially outer end of seal carrier 68 which is fastened to mounting flange 60 to the radially inner end of the seal carrier at jaws 72. Leaves 76 formed from a resilient material thereby lending axial resilience to seal carrier 76 to accommodate differential axial thermal expansion and contraction of case 57 and turbine outer air seal 62 and relative axial movement there between to maintain sealing contact between seal element 74 and sealing surface 64 of outer air seal 62 working fluid flow through the engine. As shown in FIG. 3, jaws 72 may be annularly segmented axial slots 78. Referring again to FIG. 2, the leaves 76 are formed from any suitable material having the requisite flexibility to accommodate the temperatures and pressures encountered in the working fluid flowing through the engine, such as but not limited to any of various known nickel based super alloys. Likewise, rope seal element 74 may be formed from any braided or plaited strands of such materials such as refractory material or high temperature metallic wire.

The flexibility of the seal carrier and jaws thereof may ensure that sealing contact between the rope seal and turbine outer air seal is maintained despite differential relative thermal expansion and contraction of case 57 and outer air seal 62 as well as movement thereof throughout variations in operating temperatures and pressures of working fluid through the engine. Furthermore, the resilience of seal carrier 66 allows the carrier to be axially preloaded to maintain sealing contact between sealing element 74 and surface 64 of outer air seal 62 throughout a wide range of engine operating conditions. The seal may be conveniently mounted on the engine for ease in engine assembly and maintenance.

While various embodiments of the present invention have been disclosed, it will be appreciated that various modifications to the embodiments may be made without departing from the present invention. For example, while the seal has been illustrated and described as sealing a turbine outer air seal to an engine case, it will be appreciated that the seal may be employed to seal other components in a gas turbine engine. Furthermore, while the seal carrier and rope seal have been described as being formed from specific materials, it will be understood that alternate materials capable of withstanding the temperatures and pressured encountered in gas turbine engines may be employed without departing from the present invention. Therefore, it will be understood that these and various other modifications to the embodiments illustrated and described herein may be made without departing from the present invention and it is intended by the appended claims to cover any such modifications as fall within the true spirit and scope of the invention herein.

Having thus described the invention, what is claimed is:

1. A gas turbine engine stator assembly having an axis and a pair of radially offset first and second components, said first and said second components being sealed to each other by a seal comprising:

an axially resilient seal carrier fixed to said first component, said seal carrier being fixed to said first component at a radially outer portion of said seal carrier, said seal carrier extending from said first component toward said second component and terminating at a radially inner portion of said seal carrier proximal to said second component, said radially inner portion of said seal carrier comprising a pair of radially spaced radially resilient jaws adapted to receive a sealing element there between in clamped, compressive engagement with said jaws, said sealing element being in sealing contact with said second component, said seal carrier being axially resilient to accommodate differential axial expansion and contraction and differential axial movement of said first and said second components;

the pair of radially spaced radially resilient jaws comprising a first jaw and a second jaw, the first jaw configured with a first recess, and the second jaw configured with a second recess arranged opposite the first recess;

the sealing element comprising braided or plaited strands of material clamped between the first jaw and the second jaw; and a first portion of the sealing element projecting in a first radial direction into the first recess, and a second portion of the sealing element projecting in a second radial direction into the second recess, wherein the second radial direction is radially opposite the first radial direction.

2. The gas turbine engine stator assembly of claim 1 wherein said seal carrier and said jaws are generally annular and said sealing element comprises a rope seal, and the rope seal is clamped and compressed between the first jaw and the second jaw.

3. The gas turbine engine stator assembly of claim 1 wherein said first and second components comprise an engine case and a turbine outer air seal.

4. The gas turbine engine stator assembly of claim 3 wherein said engine case is disposed radially outwardly of said turbine outer air seal, said seal carrier being fixed to said engine case at said radially outer portion of said seal carrier.

5. The gas turbine engine stator assembly of claim 4 wherein said radially outer portion of said seal is apertured to accommodate a fastener there through, said fastener fixing said seal carrier to said engine case.

6. The gas turbine engine stator assembly of claim 5 wherein said engine case includes a seal mounting flange, said seal carrier being fixed to said engine case at said seal mounting flange and wherein said fastener comprises a threaded fastener.

7. The gas turbine engine stator assembly of claim 1 wherein said carrier comprises a pair of mutually axially overlying resilient leaves, each of said leaves extending radially inwardly from said one component and terminating at a radially inner portion which includes one of said jaws formed integrally therewith.

8. The gas turbine engine stator assembly of claim 7 wherein said jaws are annular and circumferentially segmented to provide said radial resilience.

9. The gas turbine engine stator assembly of claim 1, wherein the second component is configured with a notch formed by a radially extending surface of the second component and an axially extending surface of the second component;

the sealing element projects axially out from the radially inner portion of the seal carrier into the notch;

the sealing element axially contacts the radially extending surface; and the sealing element is radially outboard of and radially spaced away from the axially extending surface by a gap.

10. A rope seal for sealing a first component of a gas turbine engine having a central axis to a second component thereof, said rope seal comprising:

an axially resilient seal carrier adapted for mounting on said first component of said gas turbine engine at a radially outer portion of said seal carrier, said seal carrier extending radially inwardly from said first component;

said seal carrier being axially resilient to accommodate differential axial expansion and contraction and relative axial movement of said first and second components due to thermal and pressure conditions of a flow of working fluid through said gas turbine engine;

said seal carrier at a radially outer portion thereof, being fixed to said first component, said seal carrier including a radially inner portion, opposite said radially outer portion and provided with a pair of radially spaced, axially extending, radially resilient jaws; and the pair of radially spaced radially resilient jaws comprising a first jaw and a second jaw, the first jaw configured with a first recess, and the second jaw configured with a second arranged opposite the first recess;

a rope sealing element formed from a plurality of strands of material that are disposed between said radially resilient jaws in clamped engagement therewith; and a first portion of the rope sealing element projecting in a first radial direction into the first recess, and a second portion of the rope sealing element projecting in a second radial direction into the second recess, wherein the second radial direction is radially opposite the first radial direction said seal carrier being adapted to locate said rope sealing element in preloaded sealing engagement with said second component of said gas turbine engine.

11. The rope seal of claim 10 wherein said seal carrier including said jaws is generally annular.

12. The rope seal of claim 10 wherein said seal carrier comprises a pair of axially overlying resilient leaves, each of said leaves extending radially inwardly from said radially outer portion of said seal carrier, each of said leaves having a radially inner portion which includes one of said jaws formed integrally therewith.

13. The rope seal of claim 10 wherein said jaws are circumferentially segmented to provide said radial resilience.

14. The rope seal of claim 10, wherein said seal carrier is adapted for mounting on a case of the gas turbine engine.

15. The rope seal of claim 10 wherein said rope sealing element is adapted for sealing engagement with a turbine outer air seal of said gas turbine engine.

16. The rope seal of claim 10 wherein said rope sealing element is formed at least in part from refractory ceramic fibers.

17. The rope seal of claim 10 wherein said rope sealing element is formed at least in part from metallic wires.

18. The rope seal of claim 10 wherein said seal carrier is formed form a nickel-based superalloy.

* * * * *